US006004150A

United States Patent [19]

Chapman et al.

[11] Patent Number: 6,004,150

[45] Date of Patent: Dec. 21, 1999

[54] CONFIGURABLE ELECTRICAL SHUNT FOR A COMPUTER CABLE

[75] Inventors: John T. Chapman, Cupertino; William H. Schenk, Fremont, both of Calif.; Robert A. Loose, Cary, N.C.

[73] Assignee: Cisco Technology, Inc., San Jose, Calif.

[21] Appl. No.: 09/001,710

[22] Filed: Dec. 31, 1997

[51] Int. Cl.[6] ..... H01R 29/00

[52] U.S. Cl. ..... 439/189; 439/507; 439/497

[58] Field of Search ..... 439/189, 507, 439/509, 497

[56] References Cited

U.S. PATENT DOCUMENTS

| | | | |
|---|---|---|---|
| 4,027,941 | 6/1977 | Narozny | 439/497 |
| 4,406,512 | 9/1983 | Schell | 439/497 |
| 4,643,507 | 2/1987 | Coldren | 439/507 |
| 4,772,212 | 9/1988 | Sotolongo | 439/497 |
| 5,267,874 | 12/1993 | Koegel et al. | 439/497 |

*Primary Examiner*—Renee S. Luebke
*Assistant Examiner*—Hae Moon Hyeon
*Attorney, Agent, or Firm*—Marger Johnson & McCollom, P.C.

[57] ABSTRACT

An electrical cable includes a connector that contains an electrically conductive shunt. The shunt includes multiple electrically conductive clips that shunt selected wires in the connector together. The chips are removable so that different combinations of wires can be shunted together. The clips each comprise a pair of vertically aligned fingers extending perpendicularly from a top surface of a mounting plate. The fingers on each clip include oppositely aligned tapered top ends forming a wide opening for receiving the cable wire. The clips extend longitudinally along an entire front end and longitudinally along an entire rear end of the mounting plate. The clips on the front end of the shunt are offset from the clips in the rear end so that each clip aligns with only one wire in the connector.

5 Claims, 3 Drawing Sheets

CONFIGURABLE ELECTRICAL SHUNT FOR A COMPUTER CABLE

This invention relates to electrical cables used for connecting computers and other electrical equipment together and more particularly to a shunt that fits inside the cable connector and reliably couples different wires in the connector together.

Computer cables are used for transferring information between computers and other electrical systems. Connector on the ends of the cables have pins that connect to interface circuitry in the computer. Often the same electrical signal in the cable is used on multiple pins on the cable connector. For example, more than one pin in the connector is often grounded. It is difficult to reliably couple common signals together on the connector. For example, any wires that connect connector pins together call eventually disconnect due to constant insertion and removal of the connector into a mating plug.

Depending on the type of interface associated with the cable, not all of the wires in the cable may be used. To reduce signal interference, the unused wires are required to be tied together. Tying or soldering together cable wires is time consuming. A small connector housing might not have enough space to hold a pigtail wire connection or multiple unused cable wires that have to be soldered together. Because coupling wires together inside a connector is unreliable or impractical, jumper wiles are often used inside the computer system to couple common signal pins together.

However, it is often impractical to use jumper wires inside a computer. For example, there are 6 primary serial interface standards currently used in the computer industry. Each interface standard has a different signal configuration when operating in a Data Terminal Equipment (DTE) mode and a different signal configuration when operating in a Data Circuit Terminating Equipment (DCE) mode. A generic interface cable and generic interface circuitry is used to connect the different types of serial interfaces together.

Some signals in the generic interface cable are required to be terminated when not used. Since different signals are used for each interface, different termination configurations are required for different serial interfaces. It is impractical to use jumper wires to connect the common signals together inside the computer system since the wired connections would have to be manually changed each time a different serial interface is used. Changing jumper wires is time consuming and also requires a computer system operator to have sophisticated knowledge of the electrical characteristics for each serial interface. There is also a need to electronically identify the type of generic interface cable so that generic interface circuitry in the computer system can be automatically reconfigured for the specific interface associated with the cable.

Accordingly, a need remains for an electrical cable that quickly and reliably shunts different combinations of wires together inside a cable.

SUMMARY OF THE INVENTION

An electrical cable according to the invention includes a connector containing an electrically conductive shunt. The shunt includes multiple electrically conductive clips that shunt selected wires in the connector together. The clips can be removed so different combinations of wires can be shunted together. The clips each comprise a pair of vertically aligned fingers forming slots that extend up from the sides of a shunt mounting plate. The fingers on each clip include oppositely aligned tapered top ends forming a wide opening floor receiving the cable wires. The clips extend longitudinally along an entire front end and longitudinally along an entire rear end of the mounting plate. The clips on the front end of the shunt are offset from the clips in the rear end so that each clip aligns with only one wire in a connector wire guide.

The fingers apply lateral oppositely opposing forces against the insulated cover. The lateral force applied by the clips provides a secure electrical connection that does not weaken even when the connections between other parts of the connector loosen over time. The shunt is used for terminating unused wires in a generic serial interface cable. A different shunt configuration is used for each cable to uniquely identify the type of interface associated with the cable.

The foregoing and other objects, features and advantages of the invention will become more readily apparent from the following detailed description of a preferred embodiment of the invention which proceeds with reference to the accompanying drawings.

DETAILED DESCRIPTION

Figure 1:
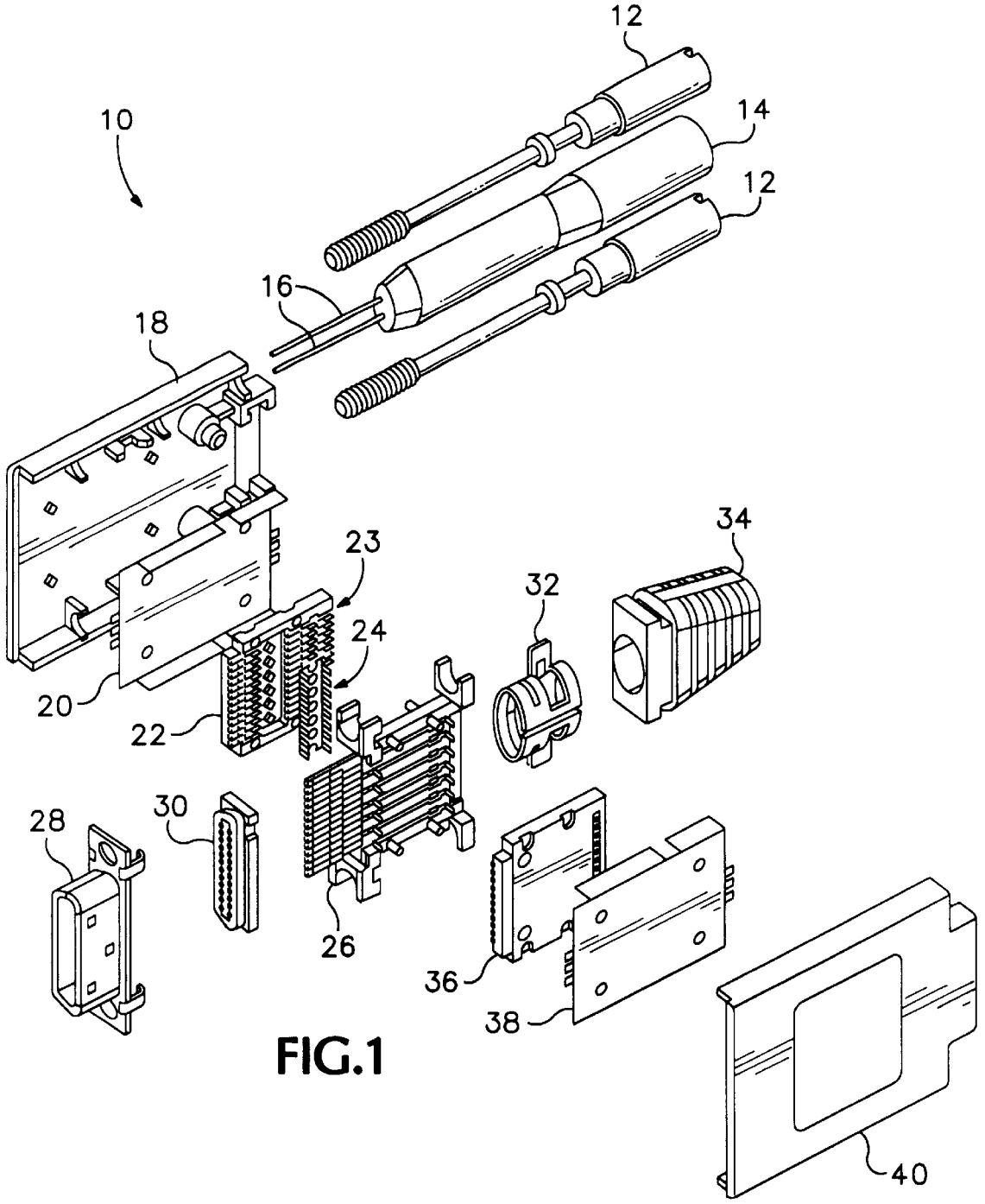
FIG. 1 an exploded perspective view of an electrical connector containing a shunt according to the invention.

Referring to FIG. 1, a connector 10 according to the invention includes a connector body 26 that receives wires 16 from a cable 14. The connector body 26 is sandwiched between a lower cover 22 and upper cover 36 each including formed wire guides 23. A shunt 24 is located between cover 22 and connector body 26. A lower metal plate 20 and an upper metal plate 38 extend around the outside surface of lower cover 22 and upper cover 36 shielding electrical signals in connector 10 from electro-magnetic interference.

The wires 16 in cable 14 are individually located in the connector body 26 and coupled to pins 29 extending from a front end of connector body 26. An alignment bracket 30 fits around the pins 29 and a mating receptor 28 fits over the alignment bracket 30 and attaches to the front end of connector body 26. A metal band 32 is wrapped around the cable 14 to provide strain relief. An overmold 34 is molded to the cable 14 providing additional strain relief for cable 14. A lower housing 18 and an upper housing 40 hold all the other pieces of the connector 10 together. Screws 12 threadingly engage with a mating receptor on a computer system (not shown).

Figure 4:
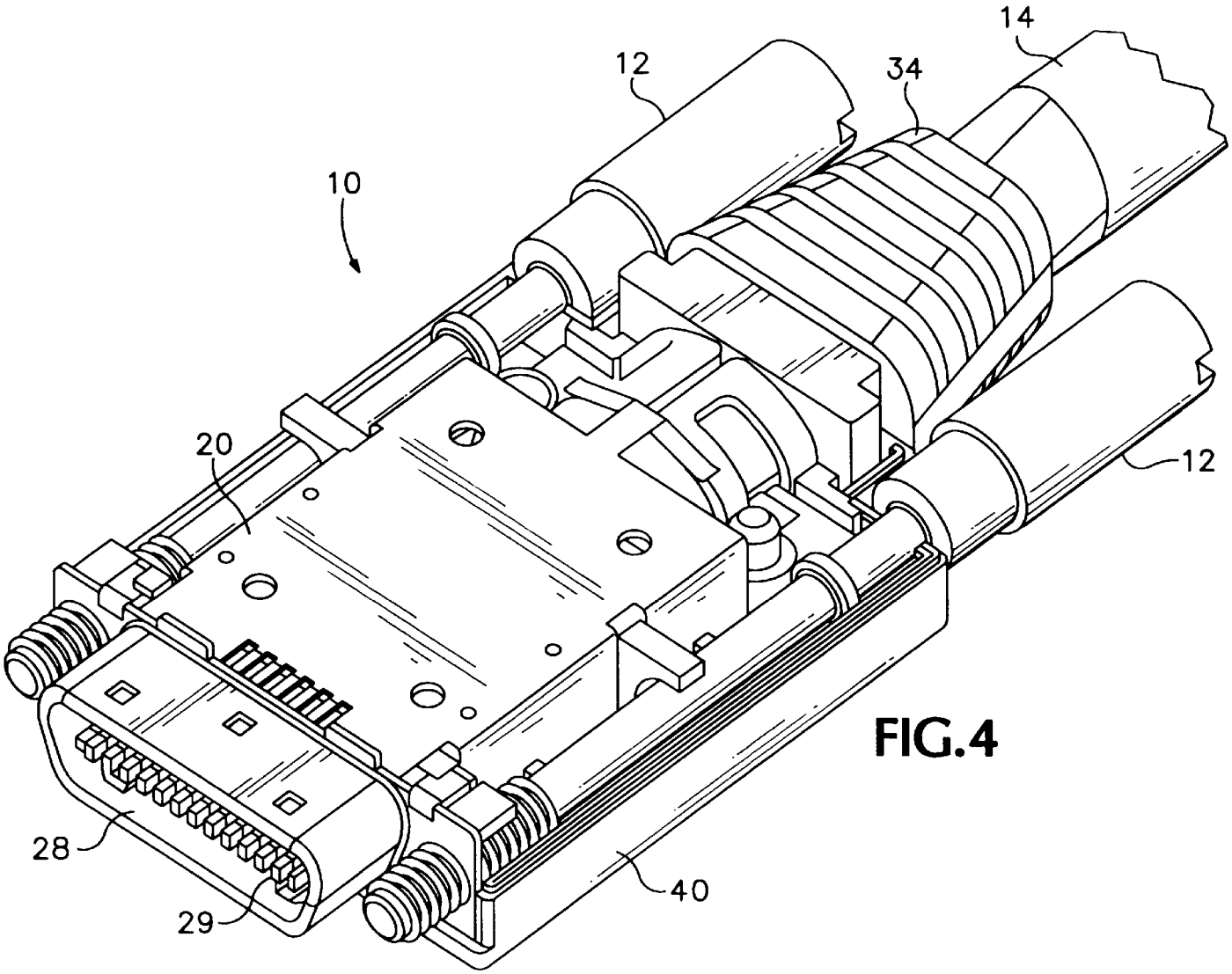
FIG. 4 is a perspective view showing the electrical connector shown in FIG. 1 in an assembled condition.

An assembled partial cutaway view of connector 10 is shown in FIG. 4. The metal plates 38 and 20 in one embodiment are made out of steel. The connector body 26, covers 22 and 36 and housings 18 and 40 are preferably made out of plastic. The shunt 12 is preferably made of a highly conductive material such as copper.

Figure 2:
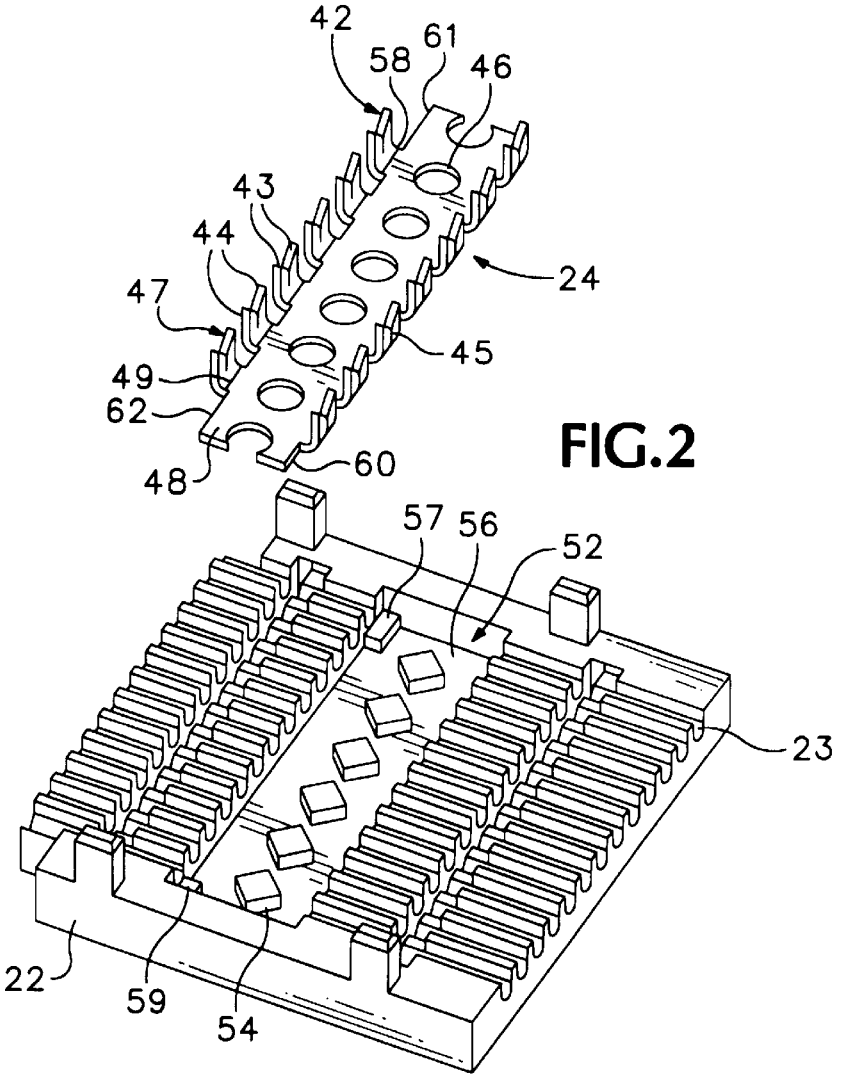
FIG. 2 is a detailed perspective view of the shunt shown in FIG. 1.

Referring to FIG. 2, the shunt 24 includes an electrically conductive mounting plate 48 having a front end 60 and a rear end 62. Multiple electrically conductive clips 42 extend up from the front end 60 and the rear end 62 of mounting plate 48. The clips 42 each receive and electrically couple to associated wires 16 (FIG. 1) in cable 14. The clips 42 in combination with the mounting plate 48 shunt together selected wires in cable 14. The clips 42 each comprise a pair of vertically aligned finger is 44 extending upward perpendicular with a top surface of the mounting plate 48. The fingers 44 on each clip 42 form a slot 45.

The fingers 44 on each clip 42 include oppositely tapering top ends 43 forming a wide openinig 47 at the top end 43 of fingers 44 that narrows toward a bottom end 49. Multiple alignment holes 46 in the mounting plate 48 receive alignment members 54 extending up from a bottom surface of cavity 52. In one embodiment, perforations 58 are formed across the bottom end 49 of each clip 42 next to the mounting plate 48. The perforations 58 allow selected clips 42 to be snapped off when the wire associated with the clip is not shunted to another wire in the cable 14.

Holes 46 in mounting plate 48 receive the alignment members 54 and keep the shunt 24 front moving in cavity 52. Extensions 57 and 59 only allow the shunt 24 to he inserted into cavity 52 in a single direction so that the front end 60 of the shunt 24 is always aligned with the same end of the cover 22. The extension 57 is wider than extension 59. Thus, only a narrower notched top end 61 of shunt 24 can be inserted at the end of caviety 52 with extension 57.

If shunt 24 were inserted backwards into cavity 52 then the clips 42 would be misaligned with the wile guides 23 shorting the wrong wires together. Thus, the holes 46 and alignment members 54 ensure the shunt 24 is always coupled to the correct wires 16 in cable 14.

The clips 42 extend longitudinally along the front end 60 and longitudinally along the real end 62 of the mounting plate 48. The clips 42 on the front end 60 are offset from the clips 42 along the cell end 62 so that no two clips 42 are aligned at the same longitudinal position on the mounting plate 48.

Figure 3:
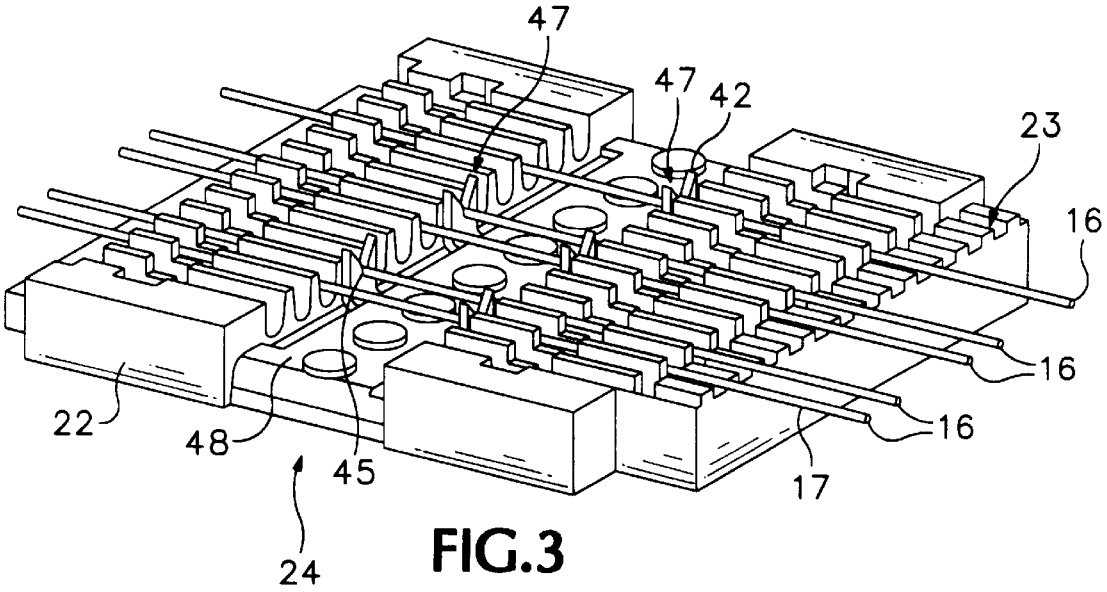
FIG. 3 is a detailed perspective view of clips in the shunt configured for shunt different wires together.

Referring to FIG. 3, when the shunt 24 is placed in cavity 52, the clips 42 each align with one of the wire guide channels 23 in cover 22. Clips 42 are selectively sheered off from mounting plate 48. The clips 42 for wires that are to be shunted together are not sheered off from mounting plate 48. When the cover 22 and the shunt 24 are pressed against the connector body 26, the wires 16 sit along the wire guide channels 23. The wires 16 insert into the top ends 47 of clip slots 45.

The wires 16 each include an insulated cover 17. The shunt fingers 44 apply oppositely opposing lateral forces that cut through the insulation 17 when the covers 22 and 36 are pressed together. The fingers 44 then provide a gas tight electrical displacement connection (IDC) with the wires 16. All the wires connected to clips 42 are then shunted together through conductive mounting plate 48. All the pieces of the connector 10 shown in FIG. 1 are pressed together and ultrasonically bonded. The ultrasonic process causes the plastic pieces in connector 10 to reflow and bond together. The ultrasonic bonding process used for bonding plastic pieces together is well known in the art and is therefore not explained in further detail.

Any type of signals can be shunted together. For example, one of the wires 16 in cable 16 can be a ground wire. Any other wires in connector 10 that need to be grounded are then shunted to the ground wire by shunt 24. Alternatively, voltage, data or control signals call be shunted to multiple wires in connector 10.

The fingers 44 apply lateral pressure to opposite sides of the wire 16. This unique arrangement of the fingers 44 on shunt 24 not only ensures a reliable connection with the wires 16 but also provides additional strain relief for the wires when the connector pins are inserted and removed from a mating connector (not shown).

The fingers 44 ensure a secure electrical connection even if the other pieces of connector 10 become slightly loose over time. The integrity of the electrical connection between the wire 16 and shunt 24 is only dependant on the lateral pressure that fingers 44 exert against the opposite sides of the wire 16 and is independent of how tight the other pieces of connector 10 are held together. Thus, if pieces of the assembled connector 10 become loose over time, the electrical integrity between wires 16 and shunt 24 is not effected.

The shunt 24 is used in combination with the generic serial connector described in co-pending patent application Ser. No. 09/001,352 filed Dec. 31, 1997 to Chapman Entitled: "Generic Serial Interface with Automatic Reconfigurability" which is herein incorporated by reference. The shunt 24 is used to identify different types of generic transition cables associated with different serial interfaces. The shunt 24 grounds mode wires in the connector 10 that are then used to identify the type of serial interface associated with the transition cable. Generic interface circuitry in the computer system reads the mode signals shunted by the shunt 24 and accordingly reconfigures the generic interface circuitry to operate with the identified serial interface.

Depending upon the type of serial interface, different signals in the transition cable are not used. To improve integrity for the signals that are used, the unused signals are required to be grounded. Generic interface circuitry in the computer system tri-states the unused signals. The wires 16 in the cable 14 associated with the unused signals are then shunted to ground by the shunt 24. Thus, wires do not have to be manually tied together inside the connector.

Having described and illustrated the principles of the invention in a preferred embodiment thereof, it should be apparent that the invention can be modified in arrangement and detail without depairing from such principles. I claim all modifications and variation coining within the spirit and scope of the following claims.

What is claimed is:

1. A shunt located inside a connector of a computer cable, comprising:

an electrically conductive mounting plate having a front end and rear end; and multiple electrically conductive removable clips extending up from at least one of the front end or rear end of the mounting plate for receiving and electrically coupling to wires extending through the computer cable, the clips having perforations for facilitating selectable removal from the mounting plate, the removable clips selectively sheared off at the perforations to provide a programmable shunting of any selectable signal to any selectable combination of the wires coupled to the clips not removed from the mounting plate.

2. The shunt of claim 1 wherein the signal programmably shunted to any combination of wires may be programmed to include a ground signal or may be programmed to not include a ground signal.

3. The shunt of claim 1 wherein the perforations are all located near the front or rear end of the mounting plate.

4. The shunt of claim 1 wherein the clips each have oppositely aligned fingers spaced apart a distance about equal to a diameter of the wires, the fingers cutting through an insulation covering an associated one of the wires.

5. The shunt of claim 1 wherein the removable clips electrically couple to the individual wires by applying opposite lateral force to opposite sides of the individual wires.

* * * * *

UNITED STATES PATENT AND TRADEMARK OFFICE

CERTIFICATE OF CORRECTION

PATENT NO. : 6,004,150
DATED : December 21, 1999
INVENTOR(S) : Chapman et al.

It is certified that error appears in the above-identified patent and that said Letters Patent is hereby corrected as shown below:

Column 1,
Line 10, “Connector” should read -- Connectors --.
Line 27, “wiles” should read -- wires --.
Line 65, “floor receiving” should read -- for receiving --.

Column 2,
Line 25, “shunt different” should read -- shunting different --.
Line 64, “aligned finger is” should read -- aligned fingers --.
Line 67, “openinig” should read -- opening --.

Column 3,
Line 10, “front moving” should read -- from moving --.
Line 11, “to he” should read -- to be --.
Line 16, “caviety” should read -- cavity --.
Line 18, “wile guides” should read -- wire guides --.
Line 22, “real end” should read -- rear end --.
Line 24, “cell end” should read -- rear end --.
Line 53, “call be shunted” should read -- can be shunted --.

Column 4,
Line 6, “effected” should read -- affected --.
Line 30, “depairing” should read -- departing --.
Line 31, “coining” should read -- coming --.

Signed and Sealed this

Twentieth Day of August, 2002

*Attest:*

*Attesting Officer*

JAMES E. ROGAN
*Director of the United States Patent and Trademark Office*